US005095782A

United States Patent [19]

Galea

[11] Patent Number: 5,095,782

[45] Date of Patent: Mar. 17, 1992

[54] OPEN-ENDED ADJUSTABLE RATCHET WRENCH

[76] Inventor: Armand Galea, Lynch St., Olyphant, Pa. 18447

[21] Appl. No.: 718,989

[22] Filed: Jun. 21, 1991

[51] Int. Cl.[5] ..... B25B 13/12

[52] U.S. Cl. ..... 81/127; 81/129; 81/129.5

[58] Field of Search ..... 81/127, 126, 129, 129.5, 81/133, 134, 142, 140

[56] References Cited

U.S. PATENT DOCUMENTS

| | | | |
|---|---|---|---|
| 770,382 | 9/1904 | Newns | 81/127 |
| 783,468 | 2/1905 | Sasko | 81/127 |
| 1,178,287 | 4/1916 | Anderson | 81/127 |
| 1,261,224 | 2/1917 | Furgerson | 81/127 |
| 1,430,694 | 10/1922 | Short | 81/127 |
| 2,160,977 | 6/1939 | Michalka . | |
| 2,707,413 | 5/1955 | Goodnow | 81/127 |
| 4,094,215 | 6/1978 | Hudson | 81/127 |
| 4,602,533 | 7/1986 | Dunn . | |
| 4,653,357 | 3/1987 | Carlmark . | |
| 4,924,735 | 5/1990 | Lee . | |
| 4,942,790 | 7/1990 | Wang . | |

*Primary Examiner*—Bruce M. Kisliuk
*Assistant Examiner*—Lawrence Cruz
*Attorney, Agent, or Firm*—Henderson & Sturm

[57] ABSTRACT

An open-ended adjustable ratchet wrench having a first jaw with a fastener contact surface thereon is slideably connected to a second jaw with a second fastener contact surface thereon for grasping a nut or bolt. A link member is pivotally attached to the first jaw along a first axis and an elongated handle is pivotally attached at one end thereof to the link member along a second axis, the second axis being parallel to the first axis. A rack having a plurality of teeth thereon is disposed on the second jaw for movement with the second jaw and is in engagement with a pinon gear rotatably attached to the link member about the first axis. A pawl is pivotally attached to the link member and has a first pivotal position for selectively engaging the teeth of the pinion gear for preventing rotation of the pinion gear in one rotary direction and permitting rotation of the pinion gear in the opposite direction and has a second pivotal position wherein the pinion gear can rotate in the opposite direction and be prevented from rotating in the first said rotary direction. A set of teeth is disposed on one end of the elongated handle for rotating with the handle about the second axis and a second set of teeth is disposed on the first jaw. The second set of teeth is engageable with the first set of teeth for causing the first jaw to pivot about the first axis in response to pivoting of the first set of teeth and the elongated handle about the second axis.

2 Claims, 2 Drawing Sheets

OPEN-ENDED ADJUSTABLE RATCHET WRENCH

TECHNICAL FIELD

The present invention relates generally to an open-ended adjustable wrench and more particularly to one of a ratchet-type that automatically tightens the jaws closed onto a nut or bolt when the handle is rotated in one direction and which opens the jaws and allows the user to get a new "bite" when the wrench is rotated in the opposite direction without removing the wrench from the nut or bolt.

BACKGROUND ART

Wrenches of many types have been devised for turning a fastener such as a nut or bolt. One common type of wrench is an open ended wrench having a fixed jaw and an adjustable jaw, sometime referred to as a crescent wrench. To use such a wrench, the jaws are placed around the head of a nut or bolt, the jaws are adjusted to fit as tightly as possible around the nut or bolt and the wrench is then used to turn the nut or bolt by moving the handle, which will turn the jaws and thereby the fastener itself. Normally circumstances dictate that the wrench cannot merely be turned 360° but must be removed from the fastener and repositioned so that several smaller arcs are utilized to achieve the number of revolutions necessary to loosen or tighten the fastener. This requires that, for each of the tightening arcs of the wrench, the jaws must be removed from the nut or bolt and then repositioned for the next stroke thereof. Besides the time-consuming problems associated with this motion, the jaws can become loose to the point where they do not sufficiently grasp the nut or bolt and consequently require frequent tightening during the process of turning a fastener. An advantage, however, of such a wrench is that it can be used in a universal fashion to loosen or tighten nuts or bolts of many sizes through a certain range depending upon the size of the wrench.

Another type of wrench useful for threaded fasteners, such as nuts or bolts, is a socket wrench of a ratchet type. These wrenches work quickly and easily because they can be set to turn a fastener in one direction and, without removing the socket from the fastener, the handle can be moved back to take a new bite without removing the socket from the fastener. These ratchet-type socket wrenches are also reversible. A major disadvantage of ratchet-type socket wrench is that it is not very adjustable, but instead the user needs to have a socket for each size of nut or bolt. Furthermore, there are places where a crescent wrench will fit that a socket wrench will not.

Consequently, there is need for a more universal wrench which will have the advantages of the aforementioned wrenches but not the disadvantages.

DISCLOSURE OF THE INVENTION

The present invention relates to an open-ended adjustable ratchet wrench having a first jaw with a fastener contact surface thereon and a second jaw with a second fastener contact surface thereon for grasping a nut or bolt. The second jaw is positioned to be movable toward or away from the first jaw. A link member is pivotally attached to the first jaw along a first axis and an elongated handle is pivotally attached at one end thereof to the link member along a second axis, the second axis being parallel to the first axis. A rack having a plurality of teeth thereon is disposed on the second jaw for movement with the second jaw and is in engagement with a pinion gear rotatably attached to the link member about the first axis.

A pawl is pivotally attached to the link member and has a first pivotal position for selectively engaging the teeth of the pinion gear for preventing rotation of the pinion gear in one rotary direction and permitting rotation of the pinion gear in the opposite direction and has a second pivotal position wherein the pinion gear can rotate in the opposite direction and be prevented from rotating in the first rotary direction.

A set of teeth is disposed on one end of the elongated handle for rotating with the handle about the second axis and a second set of teeth is disposed on the first jaw. The second set of teeth is engageable with the first set of teeth for causing the first jaw to pivot about the first axis in response to pivoting of the first set of teeth and the elongated handle about the second axis.

An object of the present invention is to provide an improved wrench.

Another object of the present invention is to provide an open-ended adjustable wrench which does not need to be removed from around a nut or bolt during the process of turning the nut or bolt.

A still further object of the present invention is to provide an open-ended adjustable wrench which will tightly grasp a fastener so that some of the pressure in turning the fastener is used to tighten the jaws together against the fastener and some of the energy used to turn the handle of the wrench is used for rotating the fastener.

A still further object of the present invention is to provide a wrench which has the best features of an adjustable crescent wrench and the best features of a ratchet-type socket wrench, but not the disadvantages thereof.

Other objects, advantages, and novel features of the present invention will become apparent from the following detailed description of the invention when considered in conjunction with the accompanying drawings.

BEST MODE FOR CARRYING OUT THE INVENTION

Figure 1:
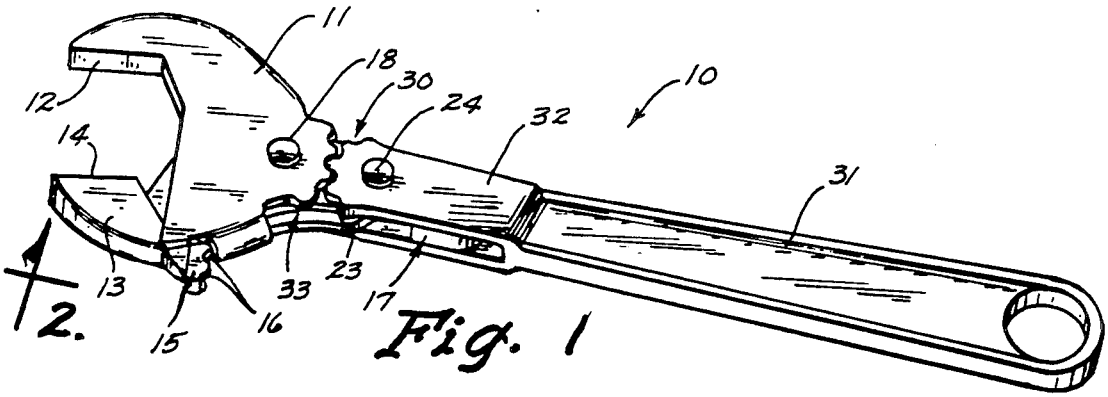
FIG. 1 is a perspective view of a preferred embodiment of the present invention.

Referring now to the drawings wherein like reference numerals designate identical or corresponding parts throughout the several views, FIG. 1 shows a wrench (10) constructed in accordance with the present invention. The wrench (10) includes a first jaw (11) with a fastener contact surface (12) disposed thereon and having a second jaw (13) with a second fastener contact surface (14) disposed thereon.

The second jaw (13) slides into and out of an opening in the first jaw (11) and has a rack (15) with teeth (16) disposed thereon.

Figure 4:
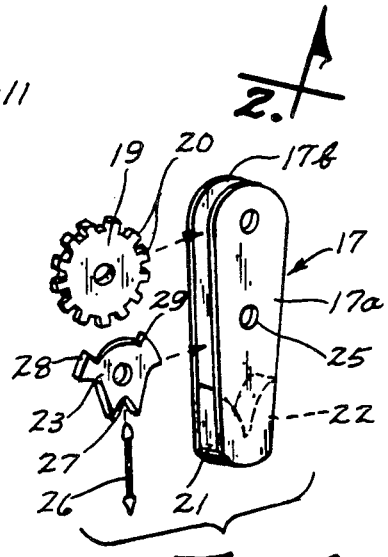
FIG. 4, is a perspective and partially exploded view of a link member having a pinion gear and pawl disposed therein with a biasing spring for the pawl.

A link member (17), as shown in FIG. 4, is pivotally attached at one end thereof to the first jaw (11) by a pin (18) and this pin (18) also extends through a pinion gear (19) and is disposed for rotary movement between members (17*a*) and (17*b*).

Figure 6:
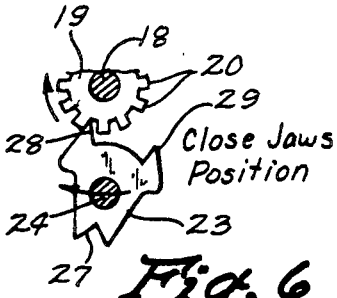
FIG. 6 shows one position of the pawl which permits the pinion gear from rotating in one direction with respect to the pawl, but allows it to move in the other direction with respect thereto.
Figure 5:
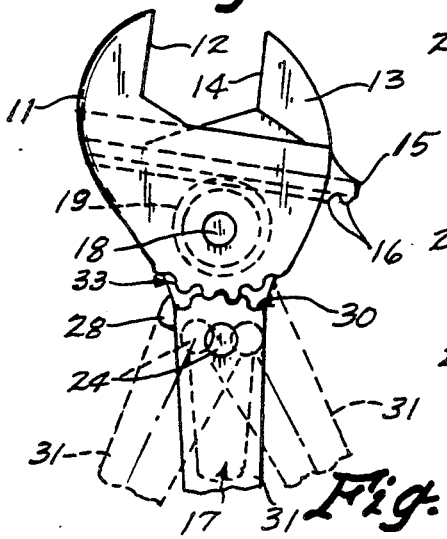
FIG. 5 is a view like FIG. 3 showing how the pivot pin in the handle moves as the handle moves.

A spacer (21) having a V-shaped groove (22) disposed therein can be welded or otherwise fastened to the members (17*a*) and (17*b*). A pawl (23) is pivotally by a pin (24) to the link member (17) through openings (25) in members (17*a*) and (17*b*). A spring member (26) extends at the bottom thereof into a groove (22) and at the top thereof into a groove (27) in pawl (23). Projections (28 and 29) can extend between the teeth (20) of pinion gear (19) as can be seen in FIGS. 6 and 7, for example.

Figure 2:
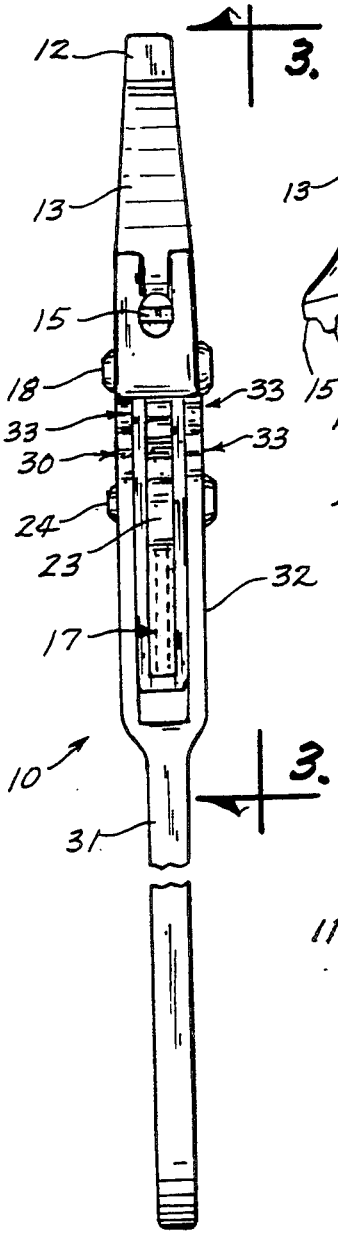
FIG. 2 is a view taken along line 2—2 of FIG. 1.
Figure 3:
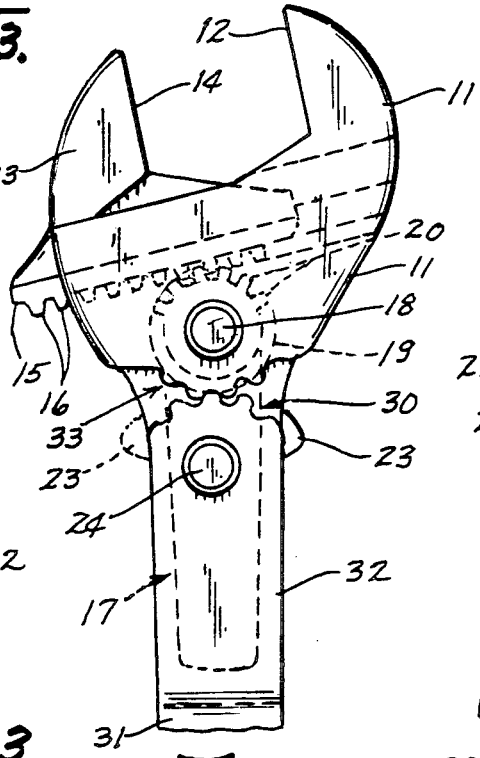
FIG. 3 is an enlarged partial view taken along line 3—3 of FIG. 2.

A first set of teeth (30) are disposed on one end of the handle (31) on each end of the forked portion (32) of the handle (31). A second set of teeth (33) are disposed on each side of the first jaw (11) as can readily be seen in FIGS. 2 and 3. The teeth of the handle (30) engage the teeth (33) of the first jaw (11).

Figure 7:
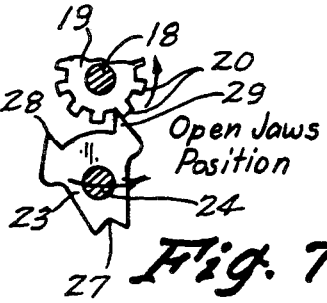
FIG. 7 shows the other position of the pawl with respect to the pinion gear and shows how the pinion gear can rotate in one direction with respect to the pawl, but not in an opposite direction with respect thereto.
Figure 13:
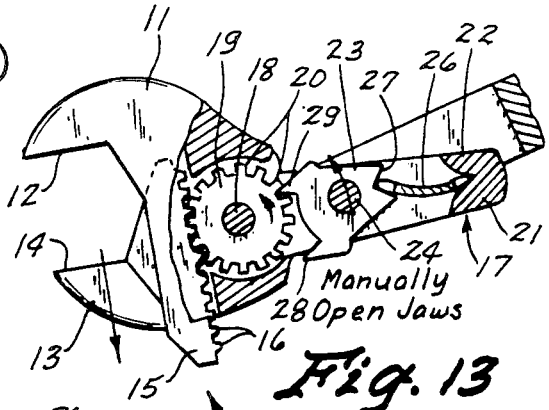
FIG. 13 is a view similar to FIG. 12, but showing the pawl move to a position which permits the jaws to be manually opened.

To use the wrench (10) shown in the drawings, the user would start with the wrench (10) in an open position by pressing the pawl (23) to the position shown in FIGS. 7 and 13 and then manually pulling the jaws (11 and 13) apart as is shown in FIG. 13 wherein the pinion gear (19) can rotate in the direction shown in FIG. 13 past the projection (29). After the jaws (11 and 13) are opened as far as are necessary to slip over a nut (40), the pawl (23) is then pushed to the position shown in FIGS. 6 and 10.

Figure 10:
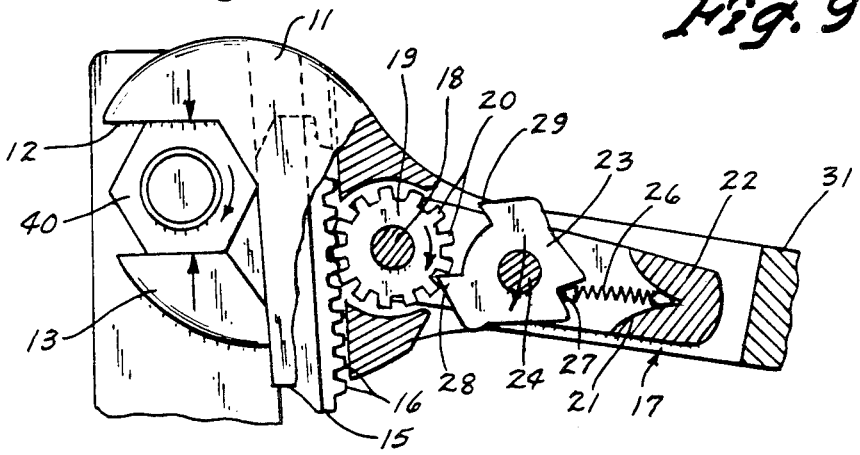
FIG. 10 is an enlarged partial side elevational view like FIG. 9, but showing part of the wrench stripped away to show the inner workings thereof.
Figure 14:
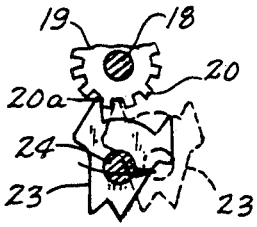
FIG. 14 is a view similar to FIG. 6, but showing how movement of the handle from the FIG. 10 position to the FIG. 11 position will move the pawl to the opposite side of one of the teeth on the pinion gear.

Once the pawl is in the position shown in FIG. 10, then the jaws (11 and 13) are manually pushed together, understanding that the pinion gear (19) can rotate past the projection (28) during this process. The next step is to move the handle from the FIG. 10 position to the FIG. 12 position which will cause the pawl (23) and projection (28) to move from one side of tooth (20) to the other side of the tooth (20), as shown in FIG. 14.

Figure 9:
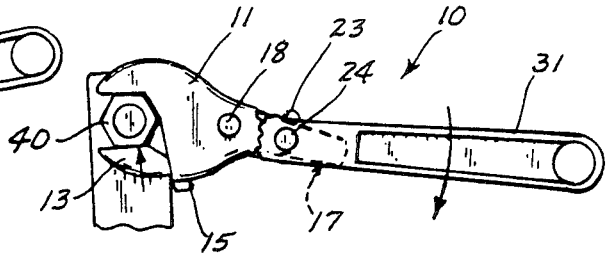
FIG. 9 shows a view similar to FIG. 8, but showing the jaws tightened down onto the nut by movement of the handle.

The wrench is then ready to turn the nut (40) in a clockwise direction, as is shown in FIGS. 9 and 10, because movement in a clockwise direction when the wrench is in the orientation shown in FIGS. 9 and 10 will cause link (17) to pivot about the axis of pin (18), as shown in FIG. 10, which will turn the pinion gear (19) in the clockwise direction, which will move the rack (15) up and consequently force the second jaw (13) against the nut (40). Once no more movement is experienced, continued movement of the handle (31) in the clockwise direction, shown in FIGS. 9 and 10, will cause the jaws (11 and 13) to turn the nut (40) in the clockwise direction while at the same time keeping the jaws (11 and 13) in tight engagement with the nut (40).

Figure 11:
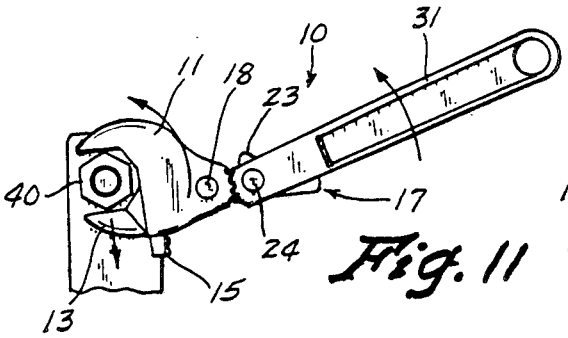
FIG. 11 is a side elevational view showing how the jaws of the wrench open up when the handle is moved in a counterclockwise direction.
Figure 12:
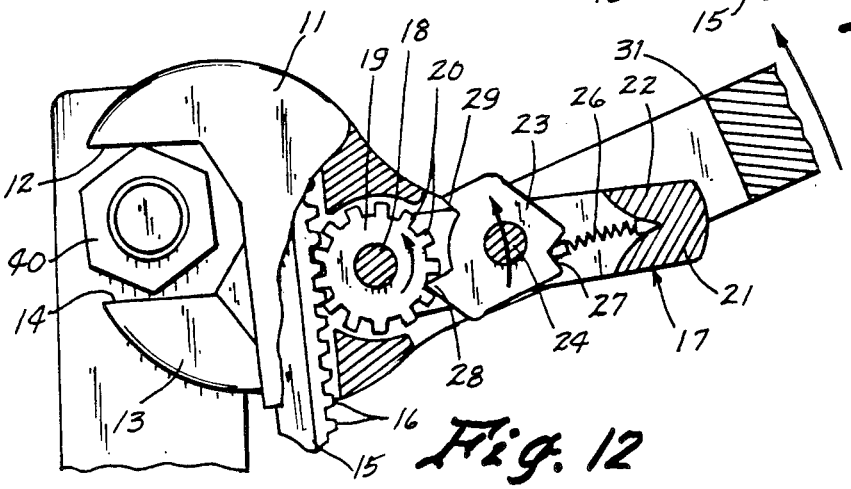
FIG. 12 is an enlarged view like that of FIG. 11, but showing a portion broken away to show the inner workings thereof.

After the nut (40) has been turned to the extent desired through a partial arc of the handle (31), the handle (31) can then be moved upwardly to the position shown in FIGS. 11 and 12. When this happens, the pressure on the jaws (11 and 13) will be relaxed and the jaws (11 and 13) are allowed to open up. In fact, movement of the lever (17) and pin (24) about the axis (18) will, to some extent, turn the pinion gear (19) in the direction shown in FIG. 12 to open the jaws while a new "bite" is achieved.

Figure 8:
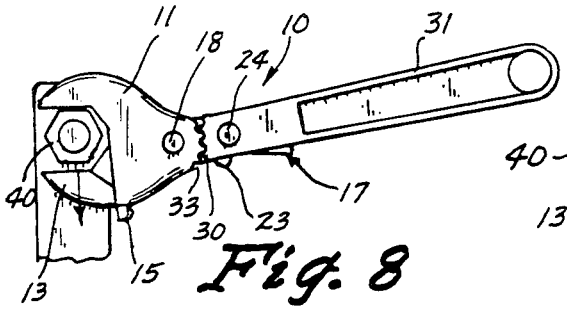
FIG. 8 is a side elevational view of the preferred embodiment shown with the jaws loosely surrounding a threaded nut fastener.

Once the wrench has been moved back up to a position, such as that shown in FIG. 8, the same procedure of pulling the handle downwardly in the direction of the arrows in FIGS. 9 and 10, is again accomplished which will, as before, tighten the jaws (11 and 13) against the nut (40). After that, continued movement of the handle (31) in a clockwise direction will again turn the nut (40) in the clockwise direction.

If it is desired to turn the nut (40) in an opposite direction, the same procedure can be done by merely flipping the wrench over 180° about the longitudinal axis of handle (31) and putting it around the same nut (40), for example, if it is desired to loosen rather than tighten the nut (40).

Accordingly, it will be appreciated that the preferred embodiment shown herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. An open ended adjustable ratchet wrench comprising:

a first jaw having a first fastener contact surface thereon;

a second jaw having a second fastener contact surface thereon;

means for permitting said second jaw to move toward or away from said first jaw whereby the distance between said first fastener contact surface and said second fastener contact surface can be changed;

a link member pivotally attached to said first jaw along a first axis;

an elongated handle pivotally attached at one end thereof to said link member along a second axis, said second axis being parallel to said first axis;

a rack having a plurality of teeth thereon being disposed on said second jaw for movement with said second jaw;

pinion gear means rotatably attached to said link member about said first axis and having teeth disposed around the exterior thereof for engagement with the teeth of said rack for selectively causing said rack to move when said pinion gear means rotates;

pawl means pivotally attached to said link member and having a first pivotal position for selectively engaging the teeth of said pinion gear means for preventing rotation of said pinion gear means in one rotary direction and permitting said pinion gear means to rotate in the opposite direction thereof and a second pivotal position thereof whereby said pinion gear means can rotate in said opposite direction and be prevented from rotating in said one rotary direction;

first teeth means disposed on said one end of said elongated handle for rotating with said elongated handle about said second axis; and second teeth means disposed on said first jaw and engageable with said first teeth means for causing said first jaw to pivot about said first axis in response to pivoting of said first teeth means and said elongated handle about said second axis.

2. The wrench of claim 1 including means operatively connected to said link member for biasing said pawl means into whichever of said first and second pivotal positions said pawl means is disposed and permitting said pawl means to be moved to the other one of said first and second pivotal positions thereof.

* * * * *